US005537955A

United States Patent [19]

Wu

[11] Patent Number: 5,537,955

[45] Date of Patent: Jul. 23, 1996

[54] HOT WATER HEATER

[76] Inventor: Ya-Ching Wu, 5F-5, No. 398, Huan N. Rd., Chung Li, Tao Yuan Hsien, Taiwan

[21] Appl. No.: 327,586

[22] Filed: Oct. 24, 1994

[51] Int. Cl.[6] ..... F22B 5/00

[52] U.S. Cl. ..... 122/13.1; 122/249; 122/332; 126/350 R; 126/373

[58] Field of Search ..... 122/13.1, 225 R, 122/249, 332; 126/350 R, 373

[56] References Cited

U.S. PATENT DOCUMENTS

| | | | |
|---|---|---|---|
| 1,803,081 | 4/1931 | Uhle et al. | 122/332 |
| 2,537,497 | 1/1951 | Weaver | 122/13.1 |
| 4,632,066 | 12/1986 | Kideys | 122/13.1 |
| 4,714,050 | 12/1987 | Nichols | 122/13.1 |
| 4,947,983 | 9/1990 | Jost | 122/13.1 |
| 5,228,413 | 7/1993 | Tam | 122/249 |
| 5,357,907 | 10/1994 | Moore, Jr. et al. | 122/13.1 |

*Primary Examiner*—Henry A. Bennett
*Assistant Examiner*—Siddmarth Ohr
*Attorney, Agent, or Firm*—Jacobson, Price, Holman & Stern

[57] ABSTRACT

A hot water heater including a housing, a plurality of heat exchanging devices connected in series and disposed inside the housing at different elevations, a heat source disposed inside the housing at the bottom and controlled to heat water in the heat exchanging devices, a cold water pipe connected to the heat exchanging device at the topmost elevation to guide cold water through the heat exchanging devices, a hot water pipe connected to the heat exchanging device at the lowest elevation to guide hot water out of the heat exchanging devices, the heat exchanging devices having vertical air ducts for guiding hot air through the heat exchanging devices, the air ducts of one heat exchanging device at a higher elevation being not vertically in alignment with that of a next heat exchanging device at a lower elevation.

3 Claims, 3 Drawing Sheets

HOT WATER HEATER

BACKGROUND OF THE INVENTION

The present invention relates to hot water heaters, and relates more particularly to such a hot water heater which has heat exchanging devices connected in series to recycle heat energy for pre-heating water permitting water to be quickly heated to the desired temperature.

Conventional hot water heaters commonly comprise a single heat exchanging device to carry water, and a gas burner to heat the flat bottom of the heat exchanging device. During the operation of a hot water heater, hot air from the heat exchanging device is directly drawn away from the housing of the hot water heater into the air, causing the air polluted. Because cold water is not pre-heated before it is guided into the heat exchanging device, it takes a lot of time and consumes a lot of energy to heat water to the desired temperature. Furthermore, when the heat source is operated to heat the heat exchanging device, heat is transmitted to water from the bottom, therefore heat cannot be evenly distributed through the inside of the hot water heater. Because different parts of the hot water heater bear different temperatures, their structural strength will be differently affected, causing the service life of the hot water heater shortened.

SUMMARY OF THE INVENTION

The present invention has been accomplished to provide a hot water heater which eliminates the aforesaid drawbacks. According to the present invention, a plurality of heat exchanging devices are connected in series and disposed inside the housing of the hot water heater at different elevations. The cold water pipe is connected to the water inlet on the heat exchanging device at the topmost elevation. The hot water pipe is connected to the water outlet on the heat exchanging device at the lowest elevation. Each heat exchanging device comprises a casing and vertical air ducts extended through the top and bottom sides of the casing. The air ducts greatly increase the heating area of the heat exchanging devices. The air ducts of one heat exchanging device at a higher elevation are not vertically in alignment with that of a next heat exchanging device at a lower elevation. When the heat source is operated to heat the heat exchanging device at the lowest elevation, rising hot air is guided through the air ducts of the heat exchanging devices at higher elevations to pre-heat water. Therefore, water can be quickly heated to the desired temperature when it passes to the heat exchanging device at the lowest elevation.

DETAILED DESCRIPTION OF THE PREFERRED EMBODIMENT

Figure 1:
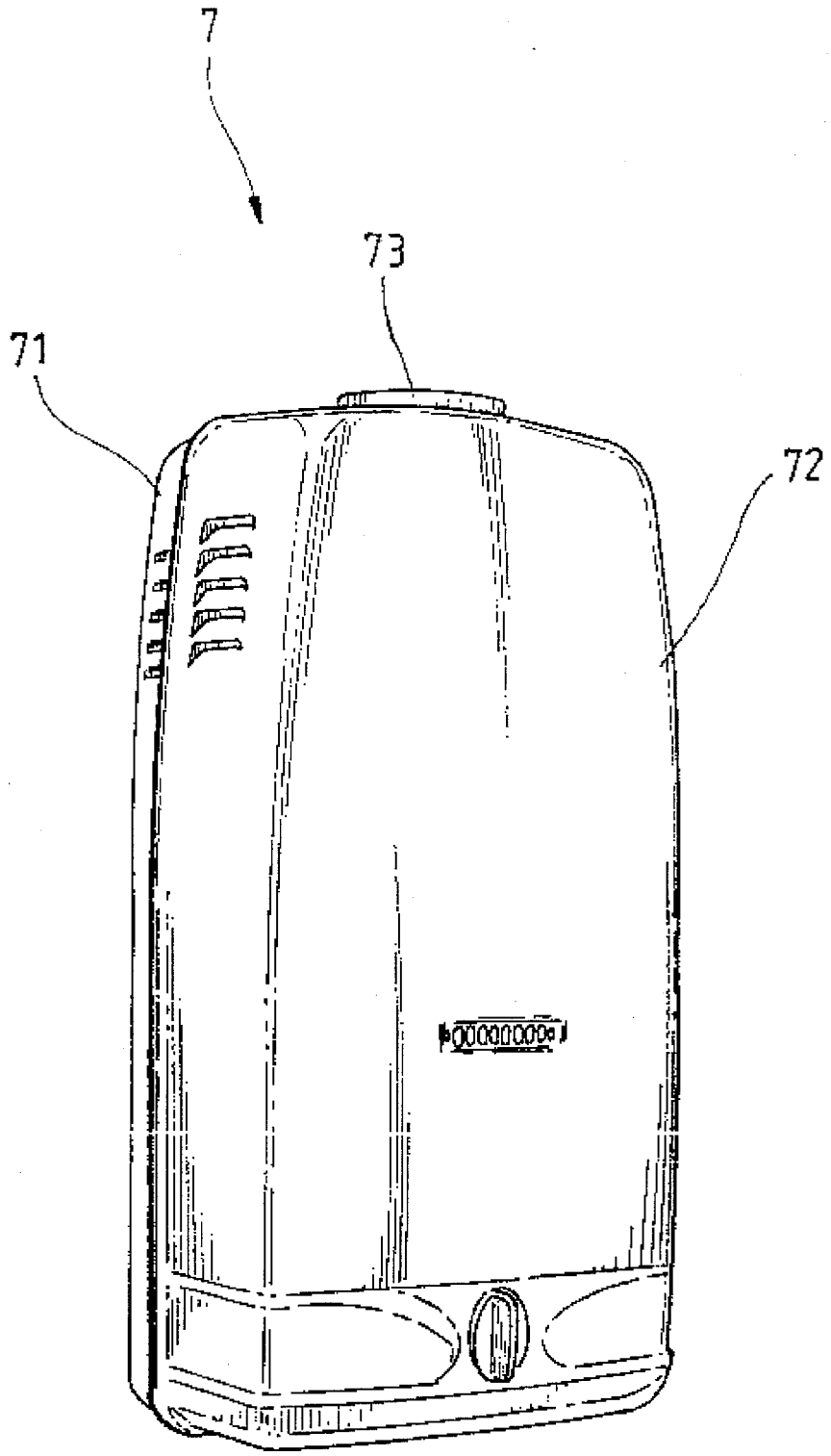
FIG. 1 is an elevational view of a hot water heater according to the preferred embodiment of the present invention.
Figure 2:
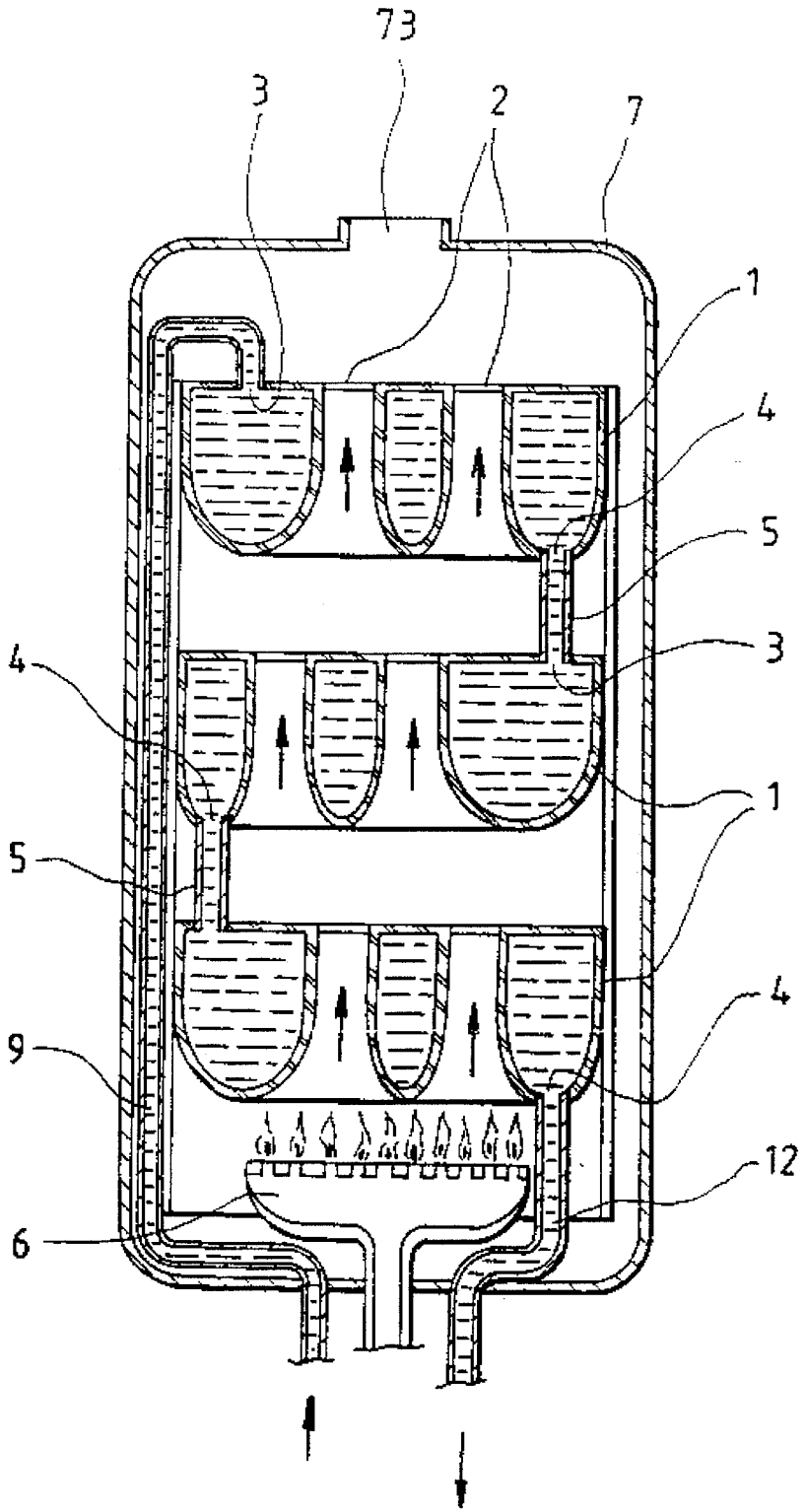
FIG. 2 is a sectional view, showing the hot water heater of FIG. 1 operated.

Referring to FIGS. 1 and 2, a hot water heater in accordance with the present invention is generally comprised of a housing 7, a heat source 6, and a plurality of heat exchanging devices 1. The housing 7 is comprised of a base frame 71 and a case-like cover frame 72 fixed to and covered over the base frame 71. An air vent 73 is made on the housing 7 at the top. The heat source 6 can be a gas burner, disposed inside the housing 7 at the bottom.

Figure 3:
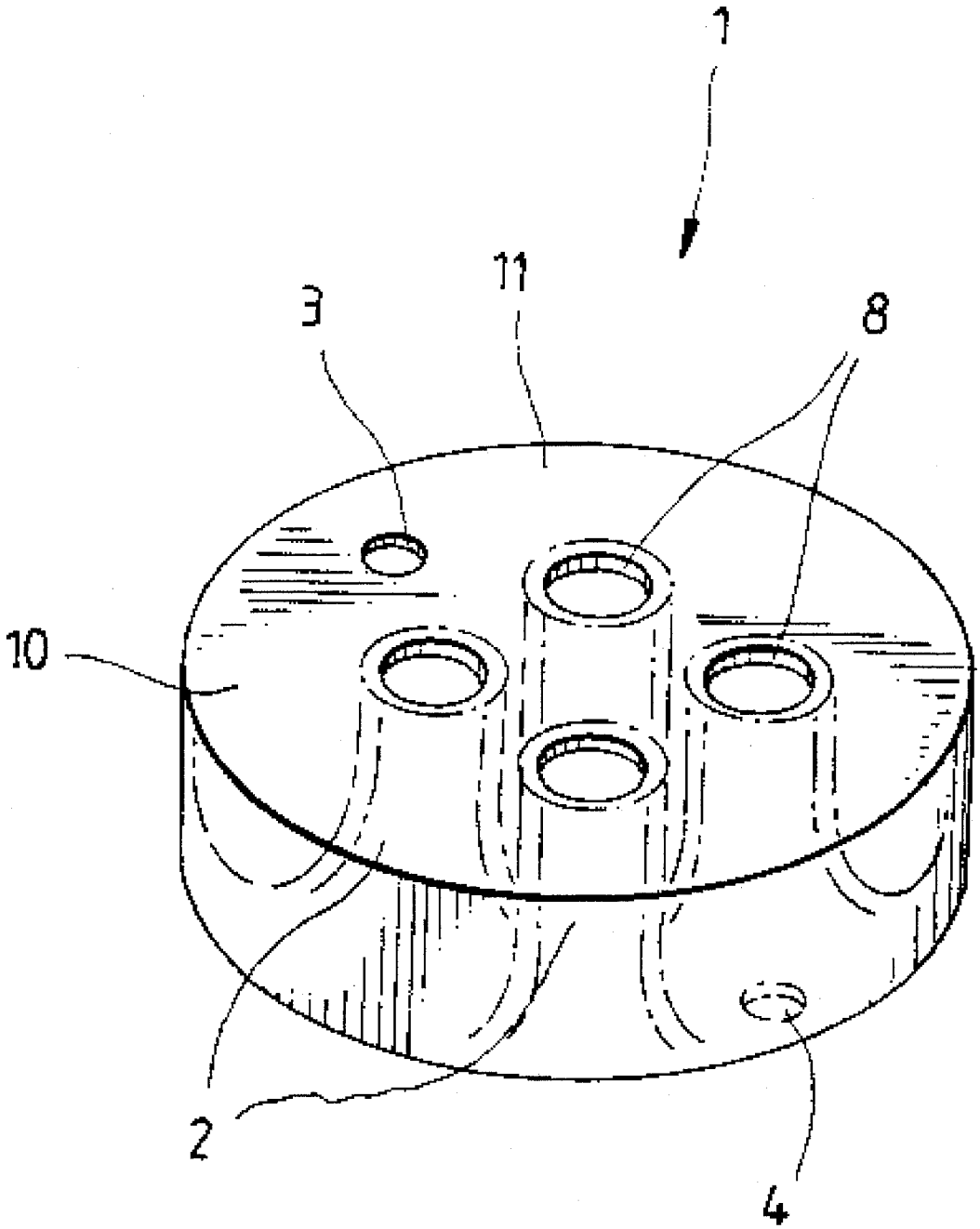
FIG. 3 is a perspective view of a heat exchanging device according to the present invention.

Referring to FIG. 3, a heat exchanging device 1 is comprised of an enclosed casing 10 of any preferred shape, having a plurality of air ducts 2 disposed on the inside. The casing 10 is covered with a top cover 11, which has a plurality of holes 8 respectively connected to the air ducts 2 and a water inlet 3. The casing 10 further comprises a water outlet 4 at the bottom communicated with the water inlet 3. The height of the air ducts 2 is equal to the height of the periphery of the casing 10, i.e., both ends of the air ducts 2 extended to both sides of the respective heat exchanging device 1 for letting hot air to pass through the respective heat exchanging device 1.

Referring to FIG. 2 again, a plurality of heat exchanging devices 1 are installed inside the housing 7 at different elevations. A cold water supply pipe 9 is connected to the water inlet 3 of the topmost heat exchanging device 1 to guide cold water from a water source (no shown) into the hot water heater. The water outlet 4 of the topmost heat exchanging device 1 is connected to the water inlet 3 of a next heat exchanging device 1, that is disposed right beneath the topmost heat exchanging device 1, by a connecting pipe 5. By connecting the water outlet 3 of one heat exchanging device 1 to the water inlet 4 of another, the heat exchanging device 1 of the hot water heater are connected in series at different elevations. The water outlet 4 of the lowest heat exchanging device 1 is connected with a hot water supply pipe 12, which is extended out of the housing 1. When installed, the air ducts 2 of each two adjacent heat exchanging devices 1 of different elevations are not vertically aligned.

When the heat source 6 is operated to heat the heat exchanging devices 1, the heat exchanging device 1 of the lowest elevation is directly heated by the heat source 6. When the heat exchanging device 1 of the lowest elevation is heated, hot air will soon rise from the heat exchanging device 1 of the lowest elevation and enter the air duct 2 of the next heat exchanging device 1 to heat water therein. Therefore, water is pre-heated by hot air before it is guided to the heat exchanging device 1 of the lowest elevation for direct heating by the heat source 6.

When hot air flows through the air ducts 2 of the heat exchanging devices 1, water is pre-heated. When water is heated to about 80° C., it will be forced to move slightly upwards. Because cold water is guided to the heat exchanging devices 1 from the top, the pressure of cold water overcomes the upward pressure of hot water. Therefore, the heat exchanging operation of the heat exchanging devices 1 will not be affected when water becomes hot.

It is to be understood that the drawings are designed for purposes of illustration only, and are not intended as a definition of the limits and scope of the invention disclosed.

What is claimed is:

1. A hot water heater comprising:

a housing having a top air vent and a bottom opening;

a heat source disposed in said bottom opening inside said housing;

a cold water pipe for guiding cold water through the hot water heater permitting it to be heated by said heat source;

a hot water pipe for guiding hot water out of the hot water heater;

a plurality of heat exchanging devices connected in series and disposed inside said housing at different elevations above said heat source, each heat exchanging device comprising an enclosed casing and at least one air duct, said at least one air duct having walls vertically extended from bottom of said enclosed casing to top of said enclosed casing to form a confined space, said enclosed casing having a water inlet on the top side and a water outlet on the bottom side communicated with said water inlet, the water outlet of one heat exchanging device at a higher elevation being connected to the water inlet of another heat exchanging device at a lower elevation, the water inlet of the heat exchanging device at the highest elevation being connected to said cold water pipe, the water outlet of the heat exchanging device at the lowest elevation being connected to said hot water pipe.

2. The hot water heater of claim 1 wherein said at least one air duct of one heat exchanging device at a higher elevation is not vertically aligned with said at least one air duct of a next heat exchanging device at a lower elevation.

3. The hot water heater of claim 1 wherein said housing is comprised of a base frame and a case-like cover frame fixed to and covered over said base frame, said cover frame having two openings respectively disposed on top and bottom walls thereof.

* * * * *